US007306679B1

(12) United States Patent
Klein et al.

(10) Patent No.: US 7,306,679 B1
(45) Date of Patent: Dec. 11, 2007

(54) COMPOSITION AND SUGAR REFINING PROCESS

(75) Inventors: Rafael A. Klein, Esteio (BR); Eduardo Wongtschowski, Sao Paulo (BR); Paulo Roberto Bernardes, Sao Leopoldo (BR)

(73) Assignee: Solae, LLC, St. Louis, MO (US)

( * ) Notice: Subject to any disclaimer, the term of this patent is extended or adjusted under 35 U.S.C. 154(b) by 0 days.

(21) Appl. No.: 11/445,570

(22) Filed: Jun. 2, 2006

(51) Int. Cl.
*C13F 3/00* (2006.01)
*C13F 1/02* (2006.01)

(52) U.S. Cl. ..... 127/30; 127/60; 127/61; 127/62; 106/217.6

(58) Field of Classification Search ..... 127/30, 127/60, 61, 62; 106/217.6
See application file for complete search history.

(56) References Cited

U.S. PATENT DOCUMENTS 5,597,416 A * 1/1997 Fuisz et al. ..... 127/30
5,827,563 A * 10/1998 Battist et al. ..... 426/572
6,132,797 A * 10/2000 Cherukuri et al. ..... 426/659

FOREIGN PATENT DOCUMENTS

JP 57-068799 A * 4/1982

* cited by examiner

*Primary Examiner*—David M Brunsman
(74) *Attorney, Agent, or Firm*—James L. Cordek; Holly M. Amjad

(57) ABSTRACT

Disclosed is a lecithinated sugar composition wherein lecithin is present in the sugar composition at not more than about 200 parts per million. Also disclosed is a process for increasing the yield of raw sugar from a clarified sugar juice stream. Further disclosed is a process for increasing the yield of refined sugar from raw sugar.

17 Claims, 6 Drawing Sheets

COMPOSITION AND SUGAR REFINING PROCESS

FIELD OF THE DISCLOSURE

The present invention relates generally to a composition and sugar refining process for producing raw sugar and/or refined sugar from a sugar bearing plant and particularly to processes for increasing the sugar yield from a sugar bearing plant by the use of a water dispersible lecithin.

BACKGROUND OF THE DISCLOSURE

In the manufacture of refined sugar from either sugar cane or sugar beets, it is important to control the process so as to yield as much sugar as possible from the sugar bearing plant. An advantage derived from the increased yield is the lower cost for the manufacture of refined sugar. The more sugar derived from the sugar plant, the less expensive it is to manufacture the sugar.

The production of cane sugar for human consumption generally comprises two distinct operations, namely the production of raw sugar and the production of refined sugar, which are often carried out in separate locations.

Production of raw sugar from sugar cane typically takes place at a sugar mill, which is usually located in or near sugar cane fields. In the mill, sugar cane stalks are chopped into pieces and the pieces are crushed in a series of roller mills in order to remove the juice. The juice from the first set of roller mills is referred to as "first juice," while the total juice from all the roller mills in the process is referred to as "mixed juice." The juice is normally limed, deaerated and clarified (i.e., removal of suspended solids, usually by sedimentation). The clarified stream is referred to as "clarified juice." The juice is then evaporated in a series of evaporators to produce a concentrated juice, that is, a thick syrup (known as "evaporated juice").

Sugar syrups, for the present purpose, are sugar solutions which are in the process of being refined. A molasses is syrup resulting from a refining process that contains some or most of the impurities of the original syrup. For identification, a syrup molasses is one resulting from the separation of sugar crystals from what has previously been a concentrated sugar-water mixture.

Sugarcane syrup from the evaporators is sent to vacuum pans, where it is further evaporated, under vacuum, to supersaturation. Fine seed crystals can be added, and the sugar ("mother liquor") yields a solid precipitate of about 50% by weight crystalline sugar. Crystallization can be a serial process. The first crystallization, also known as a strike and in this instance as an A strike, yields massecuite A that is separated into sugar A and molasses A. The term massecuite is defined as the mixture of sugar liquor and sugar crystals that is formed in the vacuum pans. The molasses A is concentrated to yield a B strike, which becomes massecuite B. The obtained massecuite B is separated into sugar B and a low-grade molasses B. The molasses B can be concentrated to yield a C strike, and the obtained massecuite C can be separated to yield a sugar C and final molasses C, sometimes referred to as blackstrap molasses. The sugar C is used as a footing in the A and B strikes. The separated sugar A and sugar B are combined and dried to produce raw sugar.

Depending on the exact nature of the process steps and conditions used in the sugar mill, the raw sugar product can be made purer. A more highly purified mill product is sometimes referred to as "Mill White", "Plantation White", or "Crystal" sugar. The production of these sugars requires sulfitation to bleach the sugar, before or after clarification, using $SO_2$ gas. It usually requires a second clarification step, usually at the syrup stage and sometimes a second sulfitation step. In nearly all cases the ash content of this sugar is much higher, perhaps by more than four times, that of refined white sugar. Although these particular mill products can be sold for human consumption without further processing in some instances, generally raw sugar must be further refined before it reaches a commercially acceptable level of purity, particularly for subsequent use by food and drink manufacturers.

Therefore, the raw sugar from a mill is usually transported to a sugar refinery for further processing. In a conventional cane sugar refining process, the raw sugar is subjected to affination by first washing the raw sugar with a not quite saturated solution of sucrose and centrifuged to remove the molasses film from the outside of the raw sugar crystals. The sugar obtained upon centrifugation is called washed sugar. The syrup formed is called affination syrup. The washed sugar is melted (dissolved) in hot water and the pH is adjusted with lime to form melter liquor.

The melter liquor is then purified, generally by the successive steps of clarification and decolorization. The clarification step usually involves forming an inorganic precipitate in the liquor, and removing the precipitate and along with it insoluble and colloidal impurities which were present in the melter liquor. In one of the clarification processes commonly used for melter liquor, termed "phosphatation," the inorganic precipitate is calcium phosphate, normally formed by the addition of lime and phosphoric acid to the liquor. The calcium phosphate precipitate is usually removed from the liquor by flotation, in association with air bubbles. Other clarification processes, termed carbonation (or carbonatation) processes, involve adding lime and carbon dioxide to the liquor, and produce calcium carbonate precipitate.

The resulting "fine liquor" is boiled to white sugar in a series of vacuum pans similar to those used in sugarcane processing. The boiling system can comprise at most six or seven stages of boiling. The first three or four strikes can be blended to make commercial white sugar. Special large-grain sugar for bakery and confectionery can be boiled separately. Fine grains or fruit sugars can be produced by sieving products of mixed grain size. Powdered icing sugar, or confectioners' sugar, results when white granulated sugar is finely ground, sieved, and mixed with small quantities of starch or calcium phosphate to keep it dry. Brown sugars (light to dark) can be either crystallized from a mixture of brown and yellow syrups with caramel added for darkest color or made by coating white crystals with a brown-sugar syrup.

Although similar in principle, the process of purifying beet sugar juice differs considerably from that employed in the raw cane sugar process. The production process of raw sugar from sugar beets starts by slicing the beets into thin chips or strips called cossettes. The sucrose is extracted from the cossettes by passing them through a diffuser countercurrent to a flow of hot leaching water. At one end of the equipment, the cossettes enter and the raw juice leaves. At the other end, the exhausted cossette pulp leaves and the hot water enters. The pH of the feed water is controlled in order to reduce the formation of invert sugar during diffusion.

In beet sugar factories, lime and carbon dioxide are used for juice purification. On passing carbon dioxide through a limed juice mixture, either simultaneously with or after liming, calcium carbonate is precipitated. The calcium carbonate crystals with their adsorbed impurities tend to cluster around pieces of organic matter, which are so large that they settle readily in tray clarifiers and can be removed satisfactorily from the underflow by vacuum filters to produce a thin juice.

The thin juice is subjected to sulfitation by the addition of a small quantity of sulfur dioxide. The sulfur dioxide is not used for bleaching the juice, but to catalytically inhibit the Maillard or browning reaction between reducing sugars and amino acids. This browning reaction is the chief cause of increased coloration of the process juices during evaporation and crystallization.

After sulfitation, the thin juice is then sent to a series of evaporators to remove moisture in order to produce a thick juice. The thick juice is subjected to vacuum pan boiling which produces a strike called massecuite. The massecuite comprises sugar crystals in a syrup of molasses. The massecuite is separated such that raw sugar crystals are removed for storage, with the remainder being the molasses. This molasses is sent to a second vacuum pan to produce a second strike massecuite of sugar crystals in a syrup. The sugar crystals are removed from this massecuite, sent to storage to be combined with the previously obtained sugar crystals. The combined sugar crystals are dried, screened, cooled, and bagged or stored in bulk.

Beet sugar processing equipment such as filters, vacuum pans, centrifuges, granulators, dryers, and screens is similar to that employed in cane refineries. Beet sugar products, as manufactured in the United States, are essentially identical with refined cane sugar products.

SUMMARY OF THE DISCLOSURE

Disclosed is a lecithinated sugar composition wherein lecithin is present in the sugar composition at not more than about 200 parts per million. Also disclosed is a process for increasing the yield of raw sugar from a clarified sugar juice stream. Further disclosed is a process for increasing the yield of refined sugar from raw sugar. The process of increasing the yield of raw sugar from a clarified sugar juice stream comprises the steps of:

(a) concentrating a clarified sugar juice stream to at least about 50° Brix to obtain a concentrated clarified sugar juice stream;

(b) crystallizing in a vacuum pan the concentrated clarified sugar juice stream to obtain a massecuite of raw sugar and raw sugar molasses;

(c) separating the raw sugar from the raw sugar molasses; and (d) at least once, repeating the vacuum pan crystallization of the raw sugar molasses to obtain an additional massecuite of raw sugar and raw sugar molasses;

wherein a water dispersible lecithin having an HLB of from about 4 up to about 13 is added to the clarified sugar juice stream, to the vacuum pan prior to crystallization, or to both the clarified sugar juice stream and to the vacuum pan, and wherein lecithin is present at from about 0.1 kilograms up to about 2.0 kilograms per 10,000 liters of massecuite.

The process of increasing the yield of refined sugar from raw sugar comprises the steps of:

(e) washing the raw sugar, with an affination syrup to obtain a washed sugar;

(f) melting the washed sugar in hot water to obtain a melter liquor;

(g) clarifying the melter liquor to obtain a clarified melter liquor;

(h) evaporating the clarified melter liquor to a concentration of at least about 50° Brix to form an evaporated liquor;

(i) crystallizing in a vacuum pan the evaporated liquor to obtain a massecuite of refined sugar and sugar molasses;

(j) separating the refined sugar from the sugar molasses; and (k) at least once, repeating the vacuum pan crystallization of the refined sugar molasses to obtain an additional massecuite of refined sugar and refined sugar molasses, wherein a water dispersible lecithin having an HLB of from about 4 up to about 13 is added to a step selected from the group consisting of (e), (f), (g), and mixtures thereof, or to the vacuum pan prior to crystallization, or to the vacuum pan prior to crystallization and to any step selected from the group consisting of (e), (f), (g), and mixtures thereof, and wherein lecithin is present at from about 0.1 kilograms up to about 2.0 kilograms per 10,000 liters of corresponding to an amount of lecithin in the lecithinated sugar of about 10-200 ppm.

DETAILED DESCRIPTION OF THE DISCLOSURE

This invention is directed to a lecithinated sugar composition, to a process for increasing the yield of raw sugar from a clarified sugar juice, and to a process for increasing the yield of refined sugar from raw sugar. Addition of a water dispersible lecithin increases the yield of raw or refined sugar and further, during the evaporation stage in both the raw sugar and the refined sugar processes, the viscosity of the syrups is decreased.

Lecithin is regarded as a well-tolerated and non-toxic surfactant. Commercial lecithin is a mixture of phospholipids as defined in Formula (I). Lecithin is obtained by degumming crude vegetable oil. A major source of lecithin is soybean oil. The term lecithin itself has different meanings when used in chemistry and biochemistry than when used commercially. Commercially, it refers to a natural mixture of neutral and polar lipids. Phosphatidylcholine, which is a polar lipid, typically is present in commercial lecithin in concentrations of about 5 to about 90%.

Lecithins are produced from vegetable, animal and microbial sources, but mainly from vegetable sources. Soybean, sunflower and rapeseed are the major plant sources of commercial lecithin. Soybean is the most common source. The main phospholipids in lecithin are phosphatidylcholine, phosphatidylethanolamine, phosphatidic acid, and phosphatidylinositol, as shown as Formula (I).

(I)

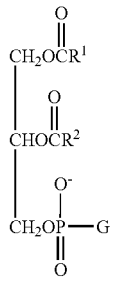

wherein $R^1$ and $R^2$ are fatty acid residues and G is selected from the group consisting of

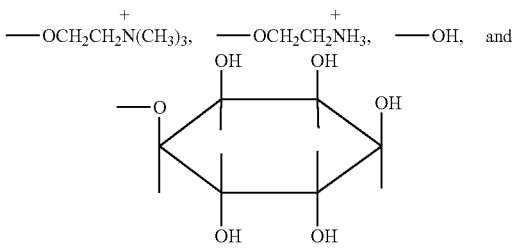

Lecithins having utility within the present invention are water-dispersible lecithins and are selected from the group consisting of acylated lecithins, oil-free lecithins, enzyme-modified lecithins, fractionated lecithins, and hydroxylated lecithins. Preferred is a hydroxylated lecithin.

Lecithins employed in the present invention have a hydrophilic-lipophilic balance (HLB) of from about 4 up to about 13, preferably from about 5 up to about 12 and most preferably from about 7 up to about 12. Examples of lecithins suitable for the present invention are SOLEC™ CA® lecithin, SOLEC F lecithin, SOLEC K-EML lecithin, SOLEC HR lecithin, SOLEC S lecithin, SOLEC A lecithin, SOLEC CPS lecithin, and SOLEC E lecithin, all of which are available from Solae, LLC, St. Louis, Mo.

The present invention is directed to a sugar composition containing not more than 200 parts per million lecithin in the sugar composition and to processes for increasing the yield of raw or refined sugar from sugar-containing plants as exemplified by sugar cane, sugar beets, sweet sorghum and maple. Regardless of the plant, ultimately a clear sugar stream is the starting material for the two process embodiments of the present invention. Preferably the sugar composition, as prepared by the above processes, contains not more than about 100 parts per million lecithin in the sugar composition.

Figure 1:
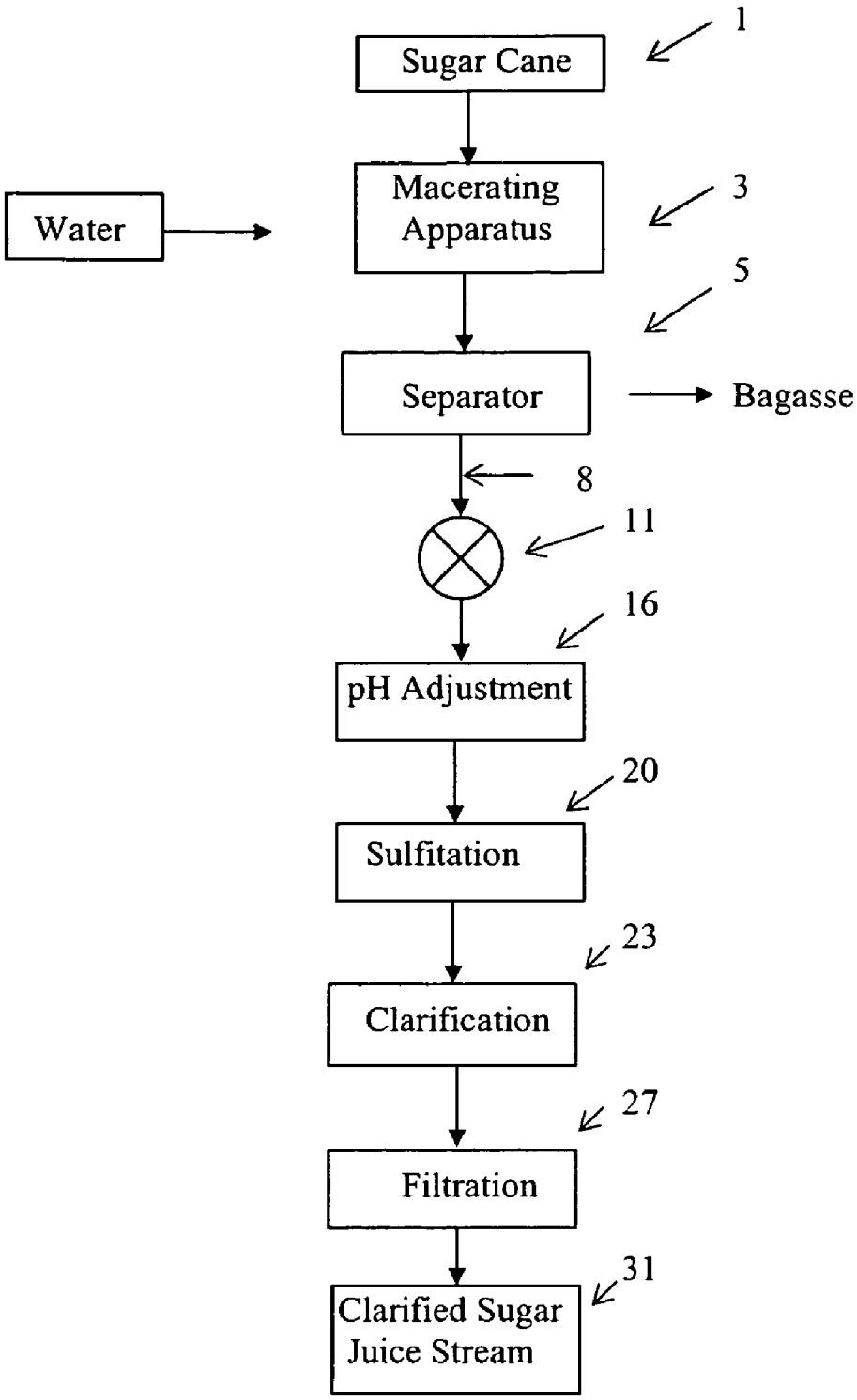
FIG. 1 is a flow sheet illustrating the sequence of steps in which clarified raw sugar juice is obtained from sugar cane.

As shown schematically in FIG. 1, in the preparation of a clear sugar stream from sugar cane, the sugar cane 1, after being harvested is prepared by first breaking it into pieces measuring a few centimeters and then by shredding the cane into a fluffy mat. The prepared cane passes into a macerating apparatus 3 that is a series of mills. Water is added to help to macerate the cane and to aid in extraction. Juice is extracted from the cane by milling, in which the cane is crushed in roller mills. Suitable hammer mills can use a set of swinging blades mounted on a vertical shaft, which force the cane material through a discharge screen. Another suitable type of hammer mill uses fixed blades. Another suitable macerating apparatus comprises one or more attrition mills that use discs as the primary attrition device. The discs preferably have grooves therein to facilitate maceration, and the discs can be horizontal or vertical in positioning. It is also possible to use both disc mills and hammer mills in series (e.g., hammer mill followed by disc attrition mill) or to have only one type of mill, a hammer mill. Water is introduced counter-currently to help extract the sugar from the macerated cane.

The macerated material leaving the macerating apparatus comprises pulp (i.e., fibrous material from the cane) and aqueous liquid that contains sucrose as well as other substances. This material is passed through a separator 5 for separation of the liquid (sucrose containing juice stream 8) from the fibrous pulp (bagasse). The separator can suitably be a centrifuge, filter, or screen (e.g., a rotating or vibrating screen, or a Dorr-Oliver DSM screen), or a combination of two or more of these.

The resulting bagasse may be dried and packaged for use as a fiber in papermaking or may be used as fuel for conventionally firing the steam boilers of the sugar mill.

After separation of the fibrous pulp from the liquid, the process can optionally include an additional step or steps to remove residual cane and silt from the separated liquid (juice). This can be done by screening and/or filtration. Preferably the screening or filtration removes at least about 90% by weight of all fibers and silt having a largest dimension of about 150 μm or greater, more preferably at least about 90% by weight of all fibers and silt having a largest dimension of about 50μ or greater.

The juice stream 8 is about 12-18° Brix, depending upon geographical location, age of cane, variety, climate, cultivation, condition of juice extraction system, and other factors. As dissolved material, it contains in addition to sucrose, some invert sugar, salts, silicates, amino acids, proteins, enzymes, and organic acids. The juice stream carries in suspension cane fiber, field soil, silica, bacteria, yeasts, molds, spores, insect parts, chlorophyll, starch, gums, waxes, and fats. Its color is brown and muddy with a trace of green from the chlorophyll.

The juice stream 8 exits the separator and is pumped to a heating tank 11. The sucrose is inverting under the influence of native invertase enzyme. This inversion is halted at 16 by raising the pH of the juice stream to between about 6-8 by the addition of lime (calcium hydroxide) and heating to at least about 100° C. to inactivate the enzyme and stop microbiological action. This stream is subjected to sulfitation 20 to remove impurities and for decolorization. The sulfitation can take place at one or more points in the process, for example, at the time of macerating the cane, in the juice after it is separated from the pulp, and/or in the feed to the evaporator. Most preferably, the sulfitation is done prior to clarification. Sulfitation is carried forth with an agent selected from the group consisting of sulfur dioxide, sulfite salts, bisulfite salts, metabisulfite salts, dithionites, and mixtures thereof, in an amount sufficient to provide an equivalent concentration of sulfur dioxide in the stream of at least about 100 ppm.

Sulfur dioxide, as well as the other named sulfitation agents, acts as an antimicrobial agent, and assists in the coagulation of such substances as albumin present in the juice. Further, the sulfur dioxide makes it possible to use more lime in the clarifying operation 23. Lime functions in several ways: adjusting the pH of the juice, forming insoluble compounds with several of the impurities present, neutralizing organic acids present, and when added in sufficient quantity, also reacting with any glucose present, converting it to organic acids. Most of the calcium compounds formed are quite insoluble and thus can be removed by settling or filtration. When phosphoric acid is added, the insoluble tricalcium phosphate is formed. The control of pH is critical if all lime is to be removed from the juice.

Within the cane sugar process, multiple stages of filtration 27 after clarification may be implemented, such as filtration using filter aid, ultrafiltration, nanofiltration, diafiltration, ion exchange, and/or electrodialysis. For example, the first filtration could take place in two or more stages of filtration, rather than taking place as a single filtration. Those skilled in the art will recognize that many other variations on the described process are also possible. It should also be recognized that the process can be operated at a variety of temperatures and other process conditions. The purpose of sulfitation, clarification, and filtration is to obtain a clarified sugar juice stream. The clarified sugar juice stream 31 has a concentration of from about 13° to about 18° Brix.

Figure 2:
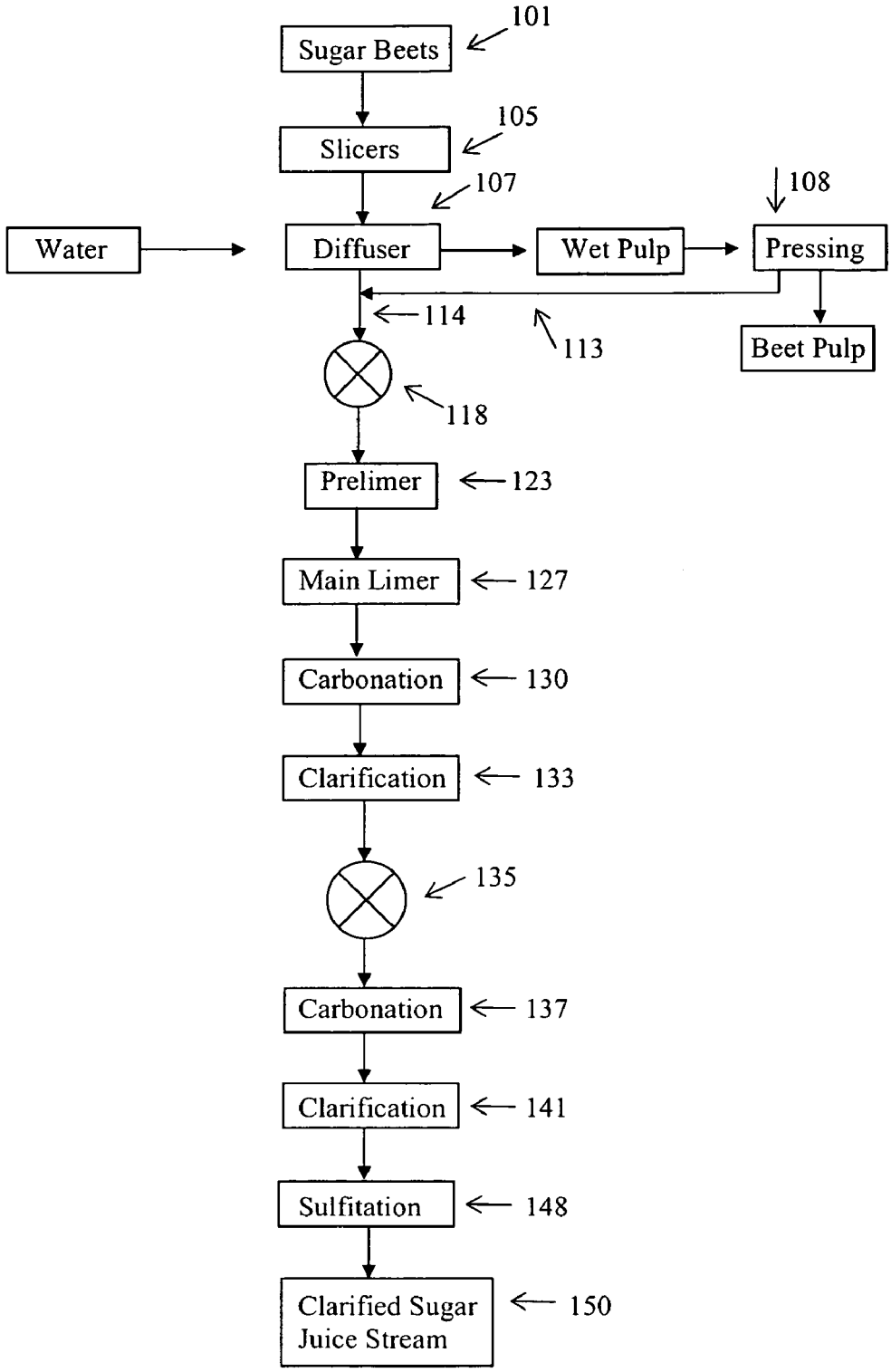
FIG. 2 is a flow sheet illustrating the sequence of steps in which clarified raw sugar juice is obtained from sugar beets.

As shown schematically in FIG. 2, in the preparation of a clarified sugar juice stream from sugar beets, the sugar beets 101, after being harvested are washed and fed into slicers 105 where very sharp knives cut them into long noodle-like pieces called cossettes. The cossettes are fed into a diffuser 107 where sugar is removed from the beets by hot water washing or diffusing to form a raw juice. The spent beets, called wet pulp, are pressed at 108 to remove any additional dissolved sugar 113, which is combined with the hot water washing at 114. The dried pulp from 108 is used for livestock feed.

Upon leaving the diffuser, the raw juice moves through various stages of purification and filtration to remove non-sugars. It is first heated to 85° C. at 118 and sent to a prelimer 123, where most of the non-sugars are precipitated by gradual pH elevation. From preliming, the juice flows through a main limer 127 where the remainder of the lime is added on its way to the first carbonation station 130. Here carbon dioxide gas is bubbled through the limed juice where it reacts with the lime to form calcium carbonate and adsorbs some of the non-sugars.

The carbonated juice flows to a clarifier 133 where the precipitated calcium carbonate formed in the first carbonation is settle out. The resulting carbonated juice is sent to heaters 135 and on to the second carbonation step 137. In the second carbonation system, carbon dioxide gas is again bubbled through the juice, reacting with residual lime to form calcium carbonate precipitate within the carbonated juice. The amount of gas is controlled by pH to obtain the proper alkalinity and the carbonated juice is sent to the second carbonation filters 141 where the calcium carbonate precipitate is removed. The carbonated juice moves on to sulfitation 148 where sulfur dioxide is added to the juice to remove any color forming materials that would carry through to the finished sugar, and to adjust the pH to allow for easier boiling in the evaporation and vacuum pans, to give the clarified sugar juice stream.

Figure 3:
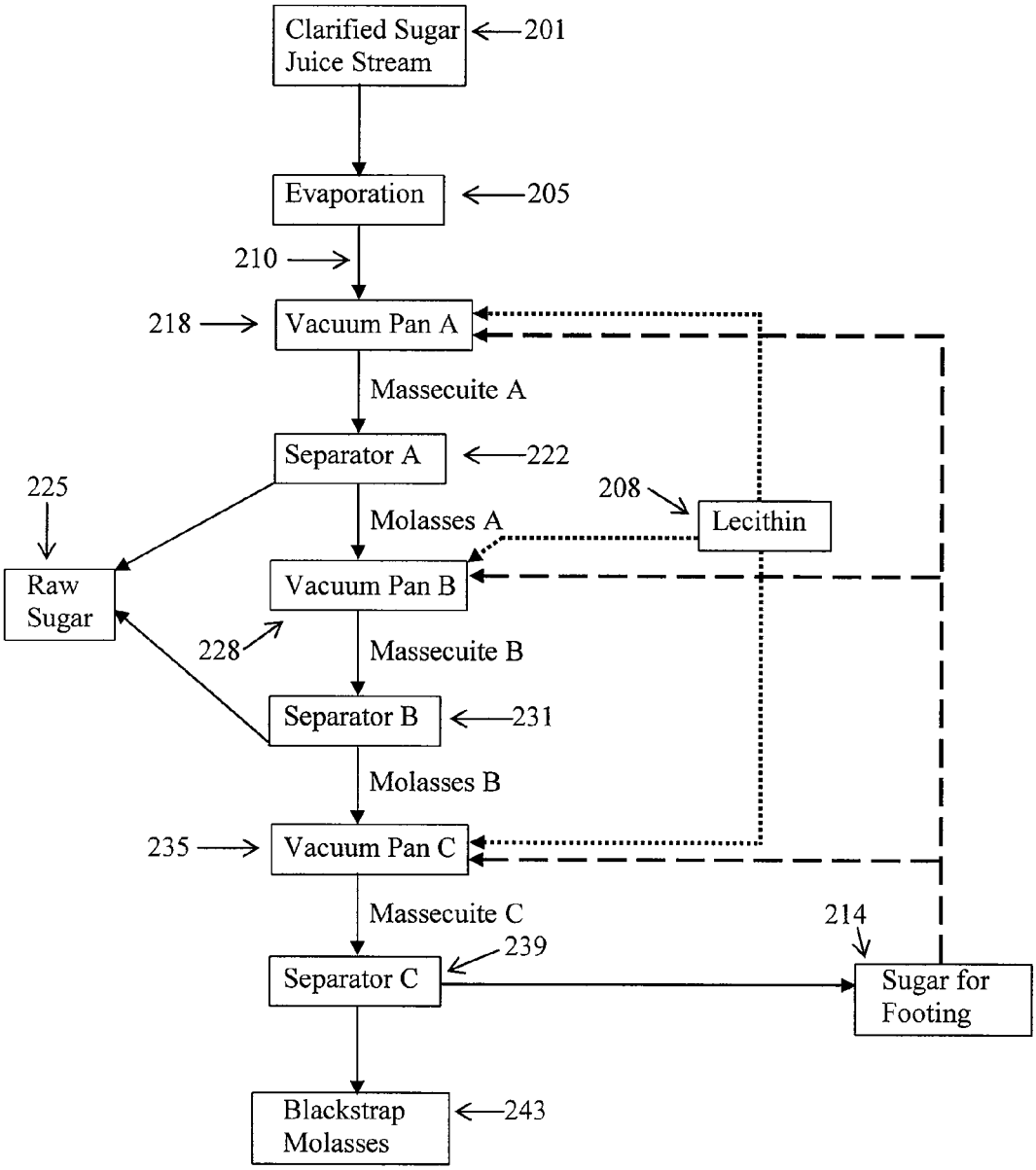
FIG. 3 is a flow sheet illustrating the sequence of steps in which raw sugar is obtained from clarified raw sugar juice.

As shown schematically in FIG. 3, the clarified sugar juice stream 201, from sugar cane or sugar beets, is then delivered to a multiple effect evaporator 205. In a multiple effect evaporator of four bodies, the clarified sugar juice stream is delivered to the first body at an inlet pressure of about 163 kPa and inlet temperature of about 114° C. At the end of the first body evaporation, the contents are discharged to the second body at a first body outlet-second body inlet of about 126 kPa and about 106° C. At the end of the second body evaporation, the contents are discharged to the third body at a second body outlet-third body inlet of about 87 kPa and about 95° C. At the end of the third body evaporation, the contents are discharged to the fourth body at a third body outlet-fourth body inlet of about 51 kPa and about 82° C. The fully evaporated syrup is discharged from the fourth body evaporator at about 14 kPa and about 52° C. and at a concentration of at least about 50° Brix, as a concentrated clarified sugar juice stream 210.

A water dispersible lecithin 208 having an HLB of from about 4 up to about 13, is added to the concentrated clarified sugar stream 210. The lecithin is added at from about 0.1 kilograms up to about 2.0 kilograms and preferably at from 0.5 kilograms up to about 1 kilogram per 10,000 liters of a massecuite. The term "massecuite" as defined above, is a mixture of sugar liquor and sugar crystals that is formed in the vacuum pans. The lecithinated concentrated sugar juice stream is then pumped to vacuum units or pans. A quantity of fine sugar crystals used as a footing or seed 214 is then added to the lecithinated concentrated sugar juice stream. This stream is then crystallized in vacuum pan A 218 to produce a strike A massecuite, which when centrifuged at 222 produces sugar crystals A and molasses A. The sugar crystals A are conveyed from the centrifuge to a sugar storage bin 225 as raw sugar. The molasses A is fed to a second vacuum pan 228 together with some footing or seed crystals where it undergoes further evaporation to obtain a strike B massecuite. Massecuite B, containing sugar crystals B and molasses B, is centrifuged at 231 to separate the sugar crystals B from the molasses B, with the sugar crystals B sent to the sugar storage bin 225 to be combined with the sugar crystals A in order to obtain the raw sugar. The molasses B is fed to a third vacuum pan 235 together with some footing or seed crystals where it undergoes further evaporation to obtain a further strike C massecuite. The massecuite C, containing sugar crystals C and molasses C, is centrifuged at 239 to separate the further sugar crystals C from the molasses C, now called blackstrap molasses 243, with the sugar crystals C to be used as footing or seed crystals 214.

The water dispersible lecithin, having an HLB of from about 4 up to about 13, can be added to the clarified sugar juice stream, to any of the vacuum pans prior to crystallization, or to both the clarified sugar juice stream and to the vacuum pans prior to crystallization. Further, when added to the vacuum pan, the lecithin may be added to vacuum pan A, vacuum pan B, vacuum pan C or any combination of vacuum pans A, B and C, to increase sugar yield. Lecithin is added in an amount of from about 0.1 kilograms up to about 2 kilograms and preferably at from about 0.5 kilograms up to about 1 kilogram per 10,000 liters of massecuite.

Figure 4:
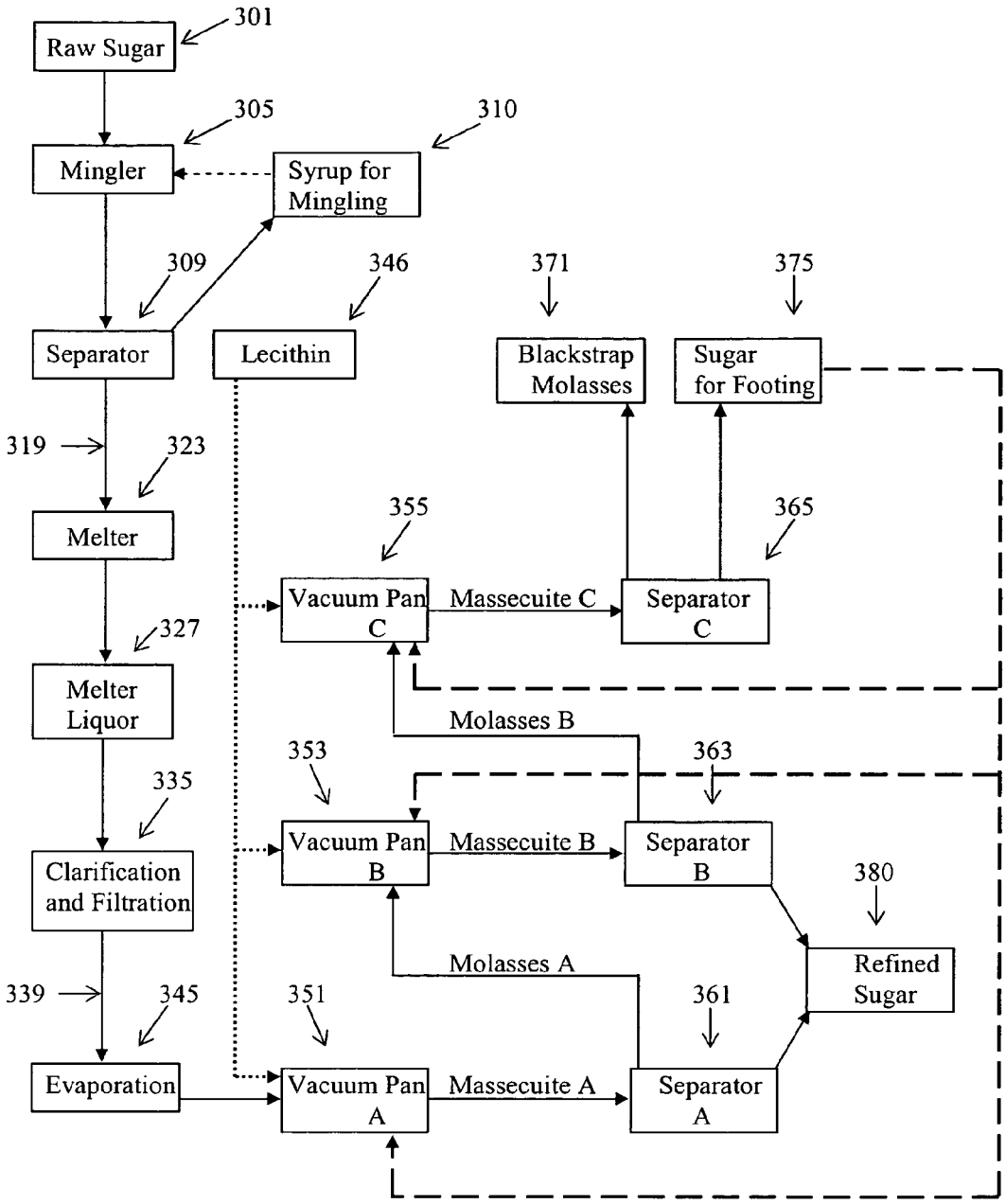
FIG. 4 is a flow sheet illustrating the sequence of steps in which refined sugar is obtained from raw sugar.

Shown schematically in FIG. 4 is the process for preparing refined sugar from raw sugar. The beginning raw sugar crystals have an outside coating of molasses that needs to be removed. This is done at step (e) by a washing process known as affination. Sugar syrup (affination syrup) 310 that is not quite saturated with sucrose is mingled at 305 with the incoming raw sugar 301. This mingled mixture is then separated in a separator 309 into affination syrup for future affination, with the remainder being a washed sugar 319. The affination syrup separated at 309 is used for mingling with additional incoming raw sugar. In step (f) the washed sugar 319 is transferred to a melter 323, where it is washed with hot water at a temperature of at least about 50° C. and pH adjusted with lime to obtain a melter liquor at 327.

The melter liquor is optionally strained through a screen to remove any debris that is present. In step (g), the melter liquor or screened melter liquor, if so screened, is then clarified at 335, generally by the successive steps of clarification, filtration and decolorization to produce clarified melter liquor 339. The clarification step usually involves forming an inorganic precipitate in the liquor, and removing the precipitate and along with it insoluble and colloidal impurities which were present in the melter liquor. In one of the clarification processes commonly used for melter liquor, termed "phosphatation," the inorganic precipitate is calcium phosphate, normally formed by the addition of lime and phosphoric acid to the liquor. The calcium phosphate precipitate is usually removed from the liquor by flotation, in association with air bubbles. Other clarification processes, termed carbonation (or carbonatation) processes, involve adding lime and carbon dioxide to the liquor to produce calcium carbonate precipitate.

The color of the clarified melter liquor 339 going into step (h), the evaporation step at 345, ranges from water white to slightly yellow. In many cases, the brix has become too low and the clarified liquor goes to evaporators to bring the brix to at least about 60°. The evaporation sequence is similar to that disclosed above in the raw sugar process.

After evaporation, to form an evaporated liquor, the evaporated liquor at step (i) is then pumped to the first vacuum pan 351. Water dispersible lecithin 346 having an HLB of from about 4 up to about 13, is added to the evaporated liquor at 351 to form a lecithinated evaporated liquor. A quantity of fine sugar crystals 375, used as a footing or seed, is then added to 351. The lecithinated evaporated liquor is then crystallized to produce a strike A massecuite, containing sugar crystals that is centrifuged at 361 to separate the sugar crystals A from the molasses called molasses A. In step (j), the sugar crystals A are conveyed from the centrifuge to a sugar storage bin 380 as refined sugar while the molasses A in step (k) is fed to a second vacuum pan 353, together with some footing or feed crystals from 375, where it undergoes further evaporation to obtain a strike B massecuite. Massecuite B is centrifuged at 363 to separate the sugar crystals B from the molasses B, with sugar crystals B sent to the sugar storage bin to be combined with the sugar crystals A in order to obtain the refined sugar. The molasses B is fed to a third vacuum pan 355 together with some footing or feed crystals from 375 where it undergoes further evaporation to obtain a strike C massecuite. The massecuite C is centrifuged at 365 to separate the sugar crystals C from the molasses now called molasses C or blackstrap molasses 371, with the sugar crystals C to be used as footing or seed 375.

The water dispersible lecithin, having an HLB of from about 4 up to about 13, can also be added to a step selected from the group consisting of (e), (f), (g), and mixtures thereof, or to any of the vacuum pans prior to crystallization, or to the vacuum pan priors to crystallization and to any step selected from the group consisting of (e), (f), (g), and mixtures thereof. Within the vacuum pans, lecithin may be added to vacuum pan A, vacuum pan B, vacuum pan C or any combination of vacuum pans A, B and C, to increase sugar yield Lecithin is added in an amount of from about 0.1 kilograms up to about 2 kilograms and preferably at from about 0.5 kilograms up to about 1 kilogram per 10,000 liters of massecuite.

The equipment used in accomplishing the process of this invention is, in general, standard and readily available from usual suppliers. Evaporators, grainers, crystallizers and centrifuges, are all long used tools of the sugar refiners' art.

The efficacy of the present invention resides in an increase of theoretical yield of a sugar process. This increase in theoretical yield relates to the equation below.

$$r=[100(j-m)/j(100-m)]\times 100$$

wherein r=% theoretical yield, j=% juice purity, and m=% honey purity

The following examples serve to illustrate the invention in more detail although the invention is not limited to the examples. Unless otherwise indicated, parts and % signify parts by weight and % by weight, respectively.

EXAMPLE 1

Figure 5:
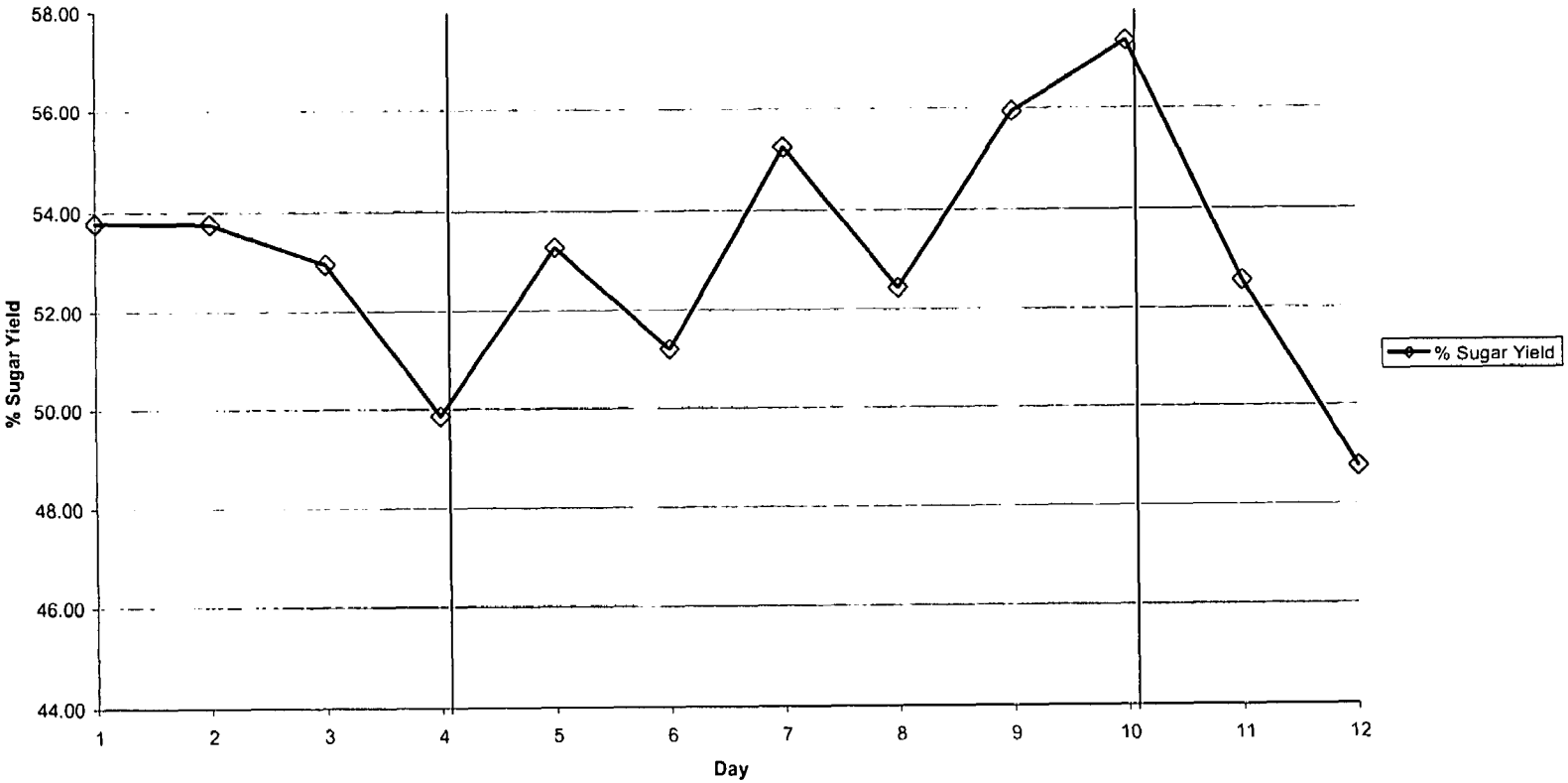
FIG. 5 is a graph of % yield vs. time in days for Example 1.

This example is directed to a sugar process that uses a two vacuum pan system to produce white sugar. In order to measure the yield increase of the process, both the massecuite B (as a j value) and molasses B purity (as an m value) are measured. Data is collected for four days prior to lecithin addition. The lecithin is added to vacuum pan B beginning at day 5 at from one kilogram of hydroxylated lecithin per 10,000 liters of massecuite B. Lecithin addition is continued for six days and then stopped. Data continues to be collected for two days after lecithin addition is complete. The results are shown in Table 1 below and in FIG. 5.

TABLE 1

| Day | j | m | r |
|---|---|---|---|
| 1 | 76.99 | 60.73 | 53.8 |
| 2 | 77.44 | 61.35 | 53.8 |
| 3 | 77.21 | 61.41 | 53.0 |
| 4 | 76.82 | 62.43 | 49.9 |
| 5 | 77.41 | 61.56 | 53.3 |
| 6 | 77.51 | 62.71 | 51.2 |
| 7 | 77.19 | 60.24 | 55.2 |
| 8 | 77.06 | 61.51 | 52.4 |
| 9 | 77.84 | 60.75 | 55.9 |
| 10 | 78.31 | 60.63 | 57.3 |
| 11 | 77.92 | 62.61 | 52.5 |
| 12 | 76.89 | 63.03 | 48.8 |

Addition of the lecithin results in an increase in the sugar yield. During this Example 1, the addition of lecithin to massecuite B causes the yield of sugar to increase from an average of 52.6% before lecithin addition for days 1 through 4 to an average of 54.2% during the lecithin addition for days 5 through 10.

EXAMPLE 2

Figure 6:
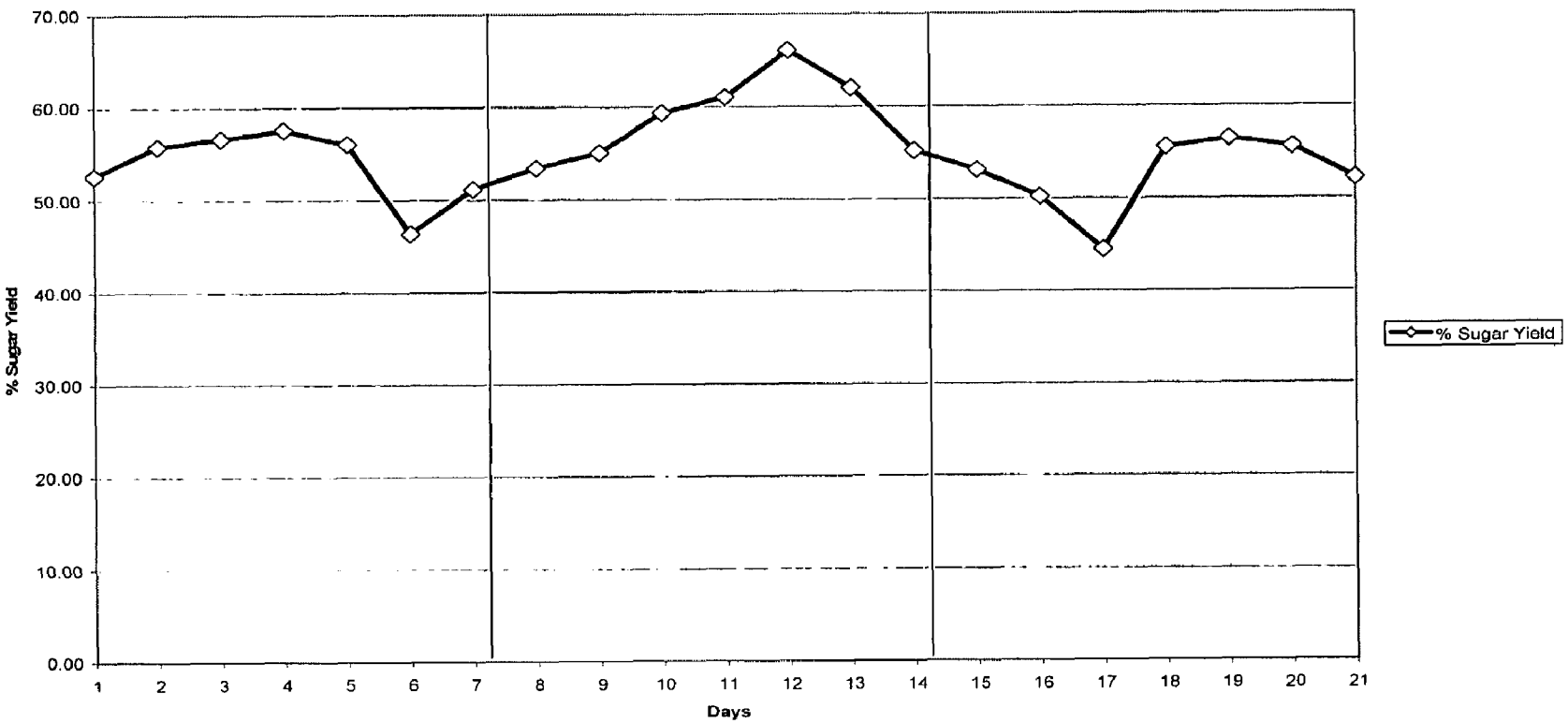
FIG. 6 is a graph % yield vs. time in days for Example 2.

This example is directed to a sugar process that uses a two vacuum pan system to produce white sugar. In order to measure the yield increase of the process, both the massecuite B (as a j value) and molasses B purity (as an m value) are measured. Data is collected for seven days prior to lecithin addition. The lecithin is added to vacuum pan B beginning at day 8 at from one kilogram of hydroxylated lecithin per 10,000 liters of massecuite B. Lecithin addition is continued for seven days and then stopped. Data continues to be collected for seven days after lecithin addition is stopped. The results are shown in Table 2 below and in FIG. 6.

TABLE 2

| Day | j | m | r |
|---|---|---|---|
| 1 | 84.07 | 71.42 | 52.65 |
| 2 | 83.80 | 69.56 | 55.82 |
| 3 | 84.98 | 71.04 | 56.64 |
| 4 | 84.63 | 70.01 | 57.60 |
| 5 | 80.95 | 65.11 | 56.08 |
| 6 | 82.32 | 71.40 | 46.38 |
| 7 | 80.68 | 67.08 | 51.21 |
| 8 | 79.21 | 63.95 | 53.44 |
| 9 | 80.90 | 65.55 | 55.08 |
| 10 | 82.60 | 65.89 | 59.31 |
| 11 | 81.86 | 63.77 | 61.00 |

TABLE 2-continued

| Day | j | m | r |
|---|---|---|---|
| 12 | 83.89 | 63.89 | 66.02 |
| 13 | 82.84 | 64.72 | 62.00 |
| 14 | 80.68 | 65.15 | 55.23 |
| 15 | 81.86 | 67.90 | 53.13 |
| 16 | 79.34 | 65.66 | 50.21 |
| 17 | 80.56 | 69.72 | 44.44 |
| 18 | 80.76 | 65.11 | 55.44 |
| 19 | 81.24 | 65.35 | 56.45 |
| 20 | 81.04 | 65.48 | 55.62 |
| 21 | 81.86 | 68.33 | 51.54 |

Addition of the lecithin again results in an increase in the sugar yield. During this Example 2, the addition of lecithin to massecuite B causes the yield of sugar to increase from an average of 53.1% before lecithin addition for days 1 through 7 to an average of 58.9% during the lecithin addition for days 8 through 14.

While the invention has been explained in relation to its preferred embodiments, it is to be understood that various modifications thereof will become apparent to those skilled in the art upon reading the description. Therefore, it is to be understood that the invention disclosed herein is intended to cover such modifications as fall within the scope of the appended claims.

What is claimed is:

1. A composition consisting essentially of a lecithinated sugar wherein the lecithin is present in about 10-200 ppm.

2. A process for producing raw sugar from a clarified sugar juice stream, consisting essentially of the steps of:

(a) concentrating a clarified sugar juice stream to at least about 50° Brix to obtain a concentrated clarified sugar juice stream;

(b) crystallizing in a vacuum pan the concentrated clarified sugar juice stream to obtain a massecuite of raw sugar and raw sugar molasses;

(c) separating the raw sugar from the raw sugar molasses; and (d) at least once, repeating the vacuum pan crystallization of the raw sugar molasses to obtain an additional massecuite of raw sugar and raw sugar molasses;

wherein a water dispersible lecithin having an HLB of from about 4 up to about 13 is added to the clarified sugar juice stream, to the vacuum pan prior to crystallization, or to both the clarified sugar juice stream and to the vacuum pan, and wherein lecithin is present at from about 0.1 kilograms up to about 2.0 kilograms per 10,000 liters of massecuite.

3. The process of claim 2 wherein the concentrated clarified sugar juice stream has a reduced viscosity.

4. The process of claim 2 wherein the water-dispersible lecithin is selected from the group consisting of acylated lecithins, oil free lecithins, enzyme modified lecithins, fractionated lecithins, hydroxylated lecithins, and mixtures thereof.

5. The process of claim 4 wherein the water-dispersible lecithin is a hydroxylated lecithin.

6. The process of claim 2 wherein lecithin is present at from about 0.5 kilograms up to about 1 kilogram of a water dispersible lecithin per 10,000 liters of massecuite.

7. The process of claim 2 wherein the clarified sugar juice stream is obtained from a sugar containing plant selected from the group consisting of sugar cane, sugar beets, sweet sorghum, maple, and mixtures thereof.

8. The process of claim 7 wherein the sugar containing plant is sugar cane.

9. The process of claim 7 wherein the sugar containing plant is sugar beets.

10. A process for producing refined sugar from raw sugar, consisting essentially of the steps of:

(e) washing the raw sugar with an affination syrup to obtain a washed sugar;

(f) melting the washed sugar in hot water to obtain a melter liquor;

(g) clarifying the melter liquor to obtain a clarified melter liquor;

(h) evaporating the clarified melter liquor to a concentration of at least about 50° Brix to form an evaporated liquor;

(i) crystallizing in a vacuum pan the evaporated liquor to obtain a massecuite of refined sugar and sugar molasses;

(j) separating the refined sugar from the refined sugar molasses; and (k) at least once, repeating the vacuum pan crystallization of the refined sugar molasses to obtain an additional massecuite of refined sugar and refined sugar molasses;

wherein a water dispersible lecithin having an HLB of from about 4 up to about 13 is added to a step selected from the group consisting of (e), (f), (g), and mixtures thereof, or to the vacuum pan prior to crystallization, or to the vacuum pan prior to crystallization and to any step selected from the group consisting of (e), (f), (g), and mixtures thereof, and wherein lecithin is present at from about 0.1 kilograms up to about 2.0 kilograms per 10,000 liters of massecuite.

11. The process of claim 10 wherein the evaporated liquor has a reduced viscosity.

12. The process of claim 10 wherein the water-dispersible lecithin is selected from the group consisting of acylated lecithins, oil free lecithins, enzyme modified lecithins, fractionated lecithins, hydroxylated lecithins, and mixtures thereof.

13. The process of claim 10 wherein lecithin is present at from about 0.5 kilograms up to about 1 kilogram of a water dispersible lecithin per 10,000 liters of massecuite.

14. The process of claim 10 wherein the water-dispersible lecithin is a hydroxylated lecithin.

15. The process of claim 10 wherein the clarified sugar juice stream is obtained from a sugar containing plant selected from the group consisting of sugar cane, sugar beets, sweet sorghum, maple, and mixtures thereof.

16. The process of claim 15 wherein the sugar containing plant is sugar cane.

17. The process of claim 15 wherein the sugar containing plant is sugar beets.

* * * * *